US010089799B2

(12) United States Patent
Stacy

(10) Patent No.: US 10,089,799 B2
(45) Date of Patent: Oct. 2, 2018

(54) DRIVING BEHAVIOUR MONITORING SYSTEMS

(71) Applicant: Wunelli Limited, Hampshire (GB)

(72) Inventor: Paul Rowan Stacy, Hampshire (GB)

(73) Assignee: Wunelli Limited, Hampshire (GB)

( * ) Notice: Subject to any disclaimer, the term of this patent is extended or adjusted under 35 U.S.C. 154(b) by 0 days.

(21) Appl. No.: 14/568,568

(22) Filed: Dec. 12, 2014

(65) Prior Publication Data

US 2015/0170436 A1 Jun. 18, 2015

(30) Foreign Application Priority Data

Dec. 12, 2013 (GB) ..... 1322030.6

(51) Int. Cl.
*G08G 1/123* (2006.01)
*G07C 5/08* (2006.01)

(52) U.S. Cl.
CPC ..... *G07C 5/0841* (2013.01); *G07C 5/0808* (2013.01)

(58) Field of Classification Search
CPC .... G07C 5/0808; G07C 5/0841; B60W 40/09
See application file for complete search history.

(56) References Cited

U.S. PATENT DOCUMENTS

2005/0208925 A1* 9/2005 Panasik ..... H04M 1/72538 455/404.1
2011/0279263 A1 11/2011 Rodkey
2013/0069802 A1* 3/2013 Foghel ..... G08G 1/205 340/989

FOREIGN PATENT DOCUMENTS

GB 2485971 6/2012

OTHER PUBLICATIONS

Search Report issued by the UK Intellectual Property Office dated May 22, 2014 in corresponding UK Application No. GB1322030.6.

* cited by examiner

*Primary Examiner* — Adam D Tissot
(74) *Attorney, Agent, or Firm* — Troutman Sanders LLP; James E. Schutz; Mark Lehi Lones

(57) ABSTRACT

A driving behavior monitoring device having a data processor and a geographic positioning module in which the processor will make a determination, based on monitored driving behavior, whether a vehicle is likely to have been involved in an accident, and record a geographical location associated with the data, and to further determine whether the device has changed its geographical position by more than a predetermined distance within a predetermined time. Driving data collected may also be used to calculate or adjust insurance premiums and/or to provide safety feedback.

18 Claims, 2 Drawing Sheets

DRIVING BEHAVIOUR MONITORING SYSTEMS

TECHNICAL FIELD

The present invention relates generally to driving behaviour monitoring systems.

BACKGROUND

It can be desirable to monitor how a vehicle is used in order to be able to use the vehicle usage data for a supplementary purpose. One use of such vehicle usage data is to be able to calculate, or adjust, a vehicle insurance premium in dependence upon how the vehicle is being used. Another use of such vehicle usage data would be to provide feedback to the driver on how they are driving, for example, how safely they are driving. We seek to provide improvements in relation to such systems.

We have appreciated that when a genuine driving accident occurs, the driver is more likely to stay within a certain distance of the vehicle (or incident or impact scene) within a certain period of time. We have devised a driving behaviour monitoring system which can determine the likelihood of a genuine driving accident.

SUMMARY

According to a first aspect of the invention there is provided a data processor, the data processor arranged to communicate with a driving behaviour monitoring device, the data processor arranged to receive and process driving behaviour data from the device including the instantaneous geographical location of the device, based on the received driving behaviour data, the data processor arranged to determine whether a vehicle, which carries the device, receives driving behaviour data which is indicative of a driving accident event, and if such an event is determined, the data processor arranged to record the geographical location associated with the event, and the data processor further arranged to determine whether the geographical location of the device has changed by more than a predetermined distance from the event location, within a predetermined amount of time.

The data processor may be termed a driving behaviour monitoring data processor.

The device may be viewed as collecting, processing and transmitting (to the data processor) driving behaviour data.

The data processor may be arranged to communicate with the device by way of a telecommunications network. The data processor may be part of a server mode.

The data processor may be arranged to determine when a sequence or combined sequence of detected events, or one of a plurality of specified events, occurs, which sequence or event is predetermined as being indicative of a potential accident. For example, such a predetermined sequence of events may include a sudden or extremely abrupt deceleration (derived from geographical positioning data), followed by an engine OFF signal (as received in a signal from the vehicles engine control unit) and the vehicle being determined to be stationary. Broadly, the data processor stores data against which real-time vehicle usage data is compared to determine if a driving accident event has occurred.

A memory of the data processor preferably stores a plurality of potential accident event sequences.

Once a (potential) accident event has been determined, the data processor is preferably then operative to store the geographical position of the (stationary) vehicle, and then determine whether the geographical position of the device exceeds the (potential accident) location by more than a predetermined amount, within a predetermined time.

Preferably the device arranged to receive a plurality of data input sources which are used to perform driving monitoring.

Preferably the device is arranged to receive data inputs including at least one of the following:

Vehicle operating data

Vehicle speed

Acceleration (including deceleration)

The device is preferably arranged to monitor for a predetermined deceleration range, which can be used, at least in part, to identify a potential accident event.

According to an alternative aspect of the invention there is provided a driving behaviour monitoring device, which comprises a data processor, the device further comprising a geographic positioning module and the processor may be arranged to determine, if sensed driving behaviour data which is indicative of a driving accident event and to record a geographical location associated with the data and to further determine whether the device has changed its geographical position by more than a predetermined distance within a predetermined time. In the alternative embodiment, the device may be arranged to process received input data which relate to real-time characteristics of the vehicle and is dynamics, so as to determine (as opposed to the data processor remote of the device) whether a potential accident event has occurred.

Preferably, when the monitoring functionality is activated, positional data of the vehicle, or data derived from the positional data, may be recorded and/or output by the device.

The device may comprise an installed software application which is operative to implement driving monitoring functionality.

The geographic positioning module is preferably arranged to communicate with a satellite positioning system, such as GPS, for example.

The device may comprise a cellular mobile telecommunications device or telephone.

The device may be enabled to determine the speed and/or acceleration of the vehicle.

The device may be arranged to determine the presence of a short range air interface communications device installed in the vehicle. The device may be arranged to detect a polling signal emitted by the communications device. The communications device may be a Bluetooth® device, for example.

The data processor may be arranged to measure changes in acceleration experienced by the device. The data processor may determine sequences of changes in acceleration experienced by the device, and compares the sequences to stored patterns of acceleration. The data processor is preferably arranged to determine whether there is sufficient similarity between the measured acceleration sequence and the stored acceleration pattern and if it is determined that there is a sufficient similarity which is indicative of a driving accident event.

According to another aspect of the invention there is provided a driving behaviour monitoring system which comprises a data processor server and a driving behaviour monitor device, the server arranged to receive driving behaviour data from the device and determine if an accident event has occurred and to evaluate the same by determining whether the device has been displaced by more that a predetermined amount in an predetermined time.

The device may be arranged to communicate with an onboard diagnostics module or engine management unit of the vehicle and to obtain vehicle usage or operational data therefrom. The onboard diagnostics module may be arranged to transmit vehicle ignition-on and vehicle ignition-off events and data from the vehicle's management system. The device may be arranged to use said data in determining whether a driving accident event has occurred.

According to a further aspect of the invention there is provided a method of operating a driving behaviour monitor, the method may comprise using driving behaviour data sensed by the device to determine whether a driving accident event has occurred.

The method may comprise using data sensed by the device within the local environment of the device, to determine if said device is in the frame of reference of a vehicle.

A further aspect of the invention relates to machine-readable instructions arranged, when executed by a data processor, to implement the auto-start functionality of the first aspect of the invention. The instructions may be realised as a software product. The software product may be suitable for installation onto a telecommunications device.

The invention may be viewed as an incident alert filtering system.

The above aspects of the invention may include any of the features described in the detailed description and/or drawings.

BRIEF DESCRIPTION OF THE DRAWINGS

Various embodiments of the invention will now be described, by way of example only, with reference to the accompanying drawings in which.

DETAILED DESCRIPTION

Figure 1:
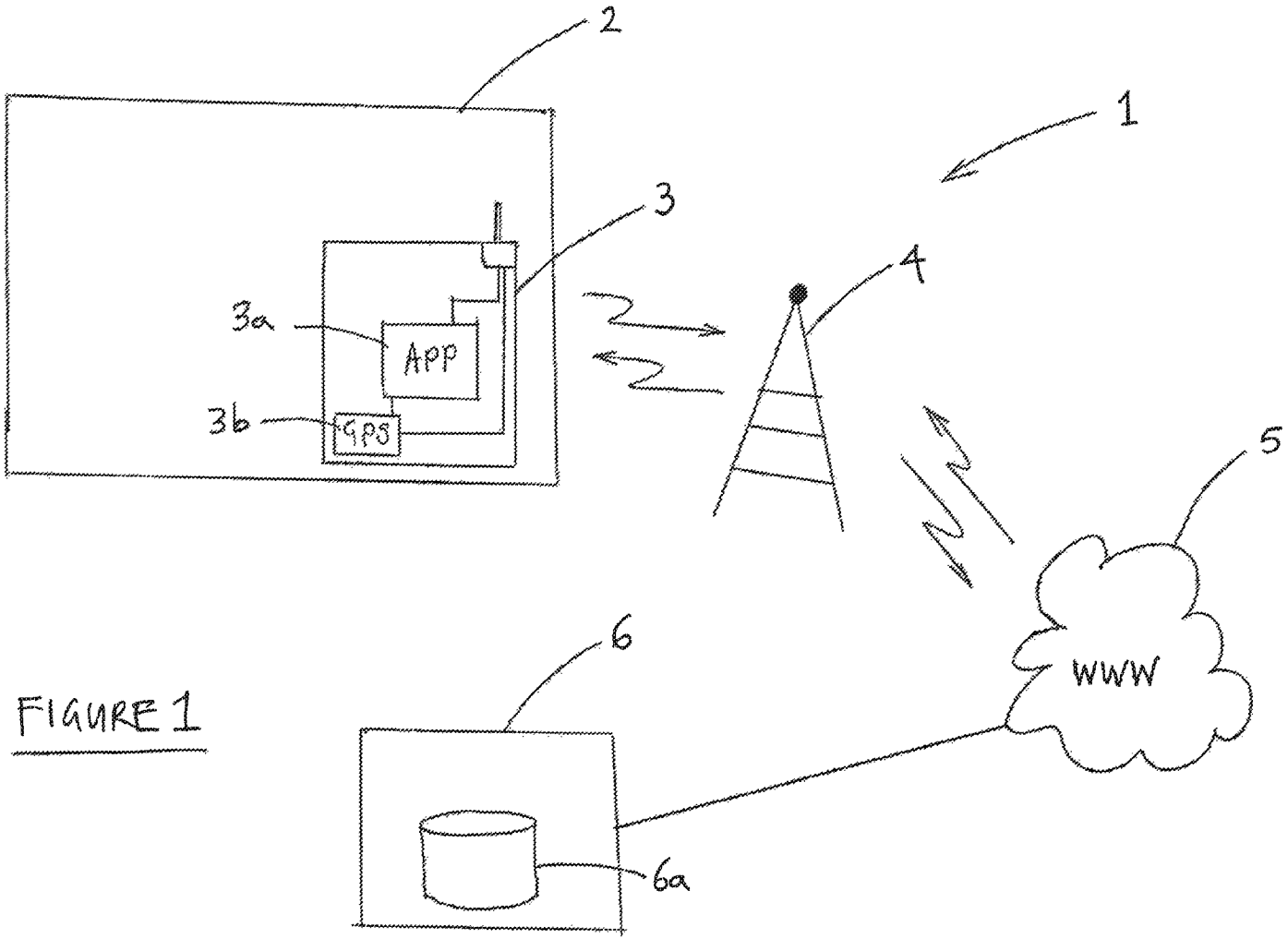
FIG. 1 is a schematic diagram of a driving behaviour monitoring system.

Reference is made initially to FIG. 1 which shows a driving behaviour monitoring system 1, which comprises a cellular mobile communications device 3, and a driving behaviour server 6. Broadly, the telephone 3 is provided with an application 3*a* which is operative, when executed by a data processor of the telephone, to monitor the driving behaviour of the user of the telephone whilst driving a vehicle 2. The application 3*a* receives driving behaviour data indicative of the driver's speed, acceleration, geographical position via a navigational positional module 3*b*, such as Global Positioning System (GPS). The application also receives data from the vehicle 2, such as the vehicle's on board diagnostics module, which generates vehicle usage data. The telephone is operative to send the data, via a telecommunications network, 4 and 5, to a server 6, where the data is processed to determine a driving behaviour score and (as described below) to determine and evaluate driving accident events. Driving scores are caused to be stored in a database 6*a*.

In use, the data processor 6 receives driving behaviour data from the device 3, by way of the telecommunications network. The data received by the device 3 includes geographic positional data (by way of communication with a satellite array), (vehicle) speed, (vehicle) acceleration, vehicle operating data (by way of data received from the vehicle's diagnostic module, which the device is arranged to communicate with).

The memory 6*a* of the data processor 6 stores data which is characteristic of a (potential) driving accident having occurred in relation to received driving behaviour data from the monitor device, and to determine whether received data correlates sufficiently to the stored data to be indicative of a (potential) driving accident. This could include a sudden deceleration and an engine OFF signal from the diagnostic module. Having recognised that an accident event has occurred, the data processor 6 stores a geographic location which is associated with the accident event data ie the accident event data arose at a particular geographic location with the triggering data being deducible from timestamp data applied to the device on sending the data to the data processor.

Figure 2:
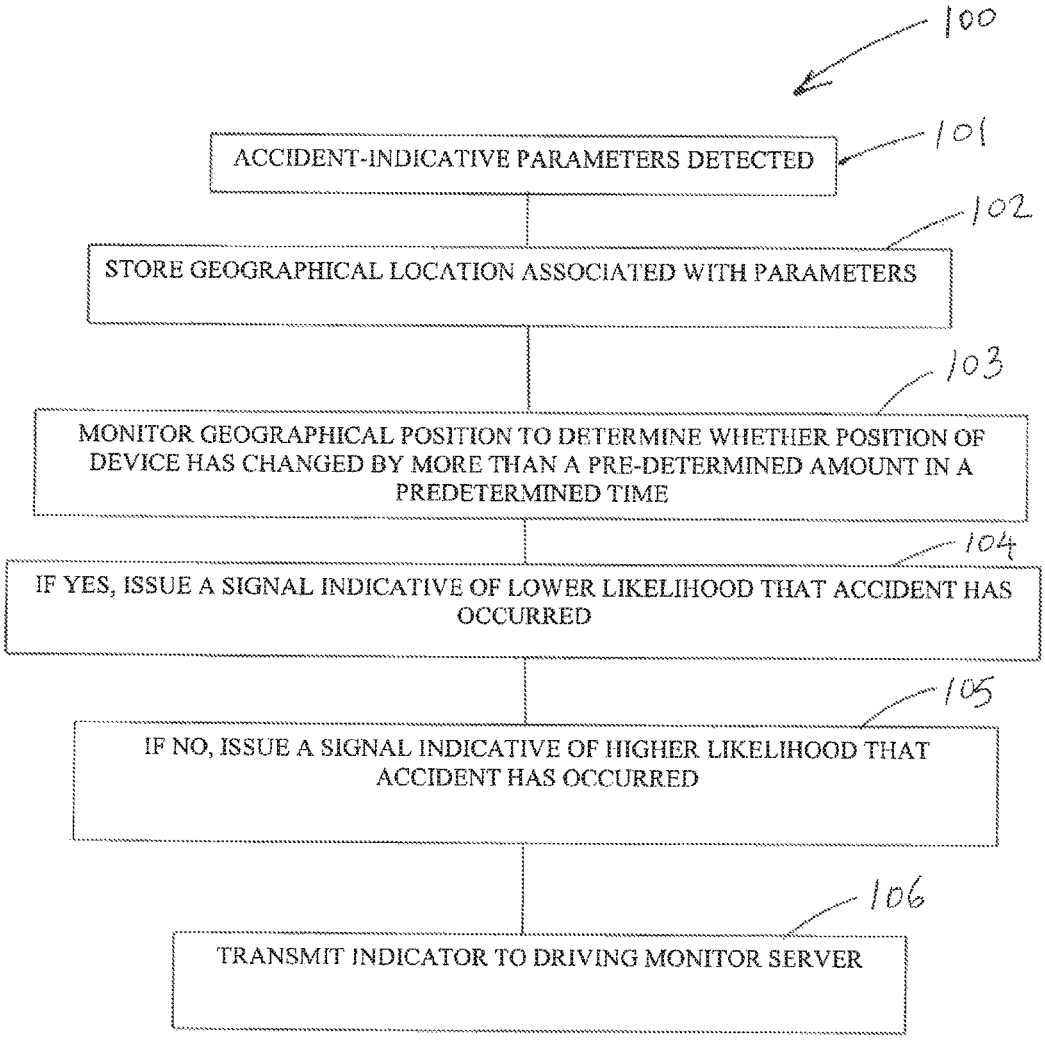
FIG. 2 is a flow diagram of a first sequence of processing steps performed by the device to determine if a driving accident event has occurred.

Having now determined that an accident event has occurred, and having stored the geographic location, the processor now implements a routine which serves to determine whether it is more or less likely that the accident event does instead relate to an actual traffic accident, such as a collision. The processor now commences a timer which is operational for a predetermined period. During that period the processor receives, periodically, updates of geographic position data of the device 6. If, during the predetermined time, the processor determines that the device 6 has moved further away from the accident event location by more than a predetermined distance, the processor determines that it is less likely that an actual accident has occurred. If, however, the device does not exceed that predetermined distance in the given time, it is more likely that an actual traffic accident has occurred, in the latter case, the data processor records on the memory details of the time and location of the accident. However, it may be that the driver has simply had to make an emergency stop and the engine stalled, with no injury to the driver, or any damage to the user's vehicle or a third party's vehicle or property. The process which is conducted by the processor is shown in FIG. 2 which shows a flow diagram with steps 101 to 106.

The above process is of particular advantage in being able to provide a meaningful indication to an insurance provider of the user, as to the likelihood of an accident having occurred. This information may be used by the insurance provider to adjust the user's premium and/or to challenge the veracity of a false insurance claim for a fraudulent claim of a (non-existent) accident. The apparatus described above may be viewed as an incident alert filtering system with the capacity to filter out events that are unlikely to be actual/genuine accident alerts.

The invention claimed is:

1. An apparatus comprising a data processor configured to communicate with a driving behaviour monitoring device, the data processor configured to receive and process driving behaviour data from the device including the instantaneous geographical location of the device, based on the received driving behaviour data, the data processor further configured 1) to determine whether a vehicle, which carries the device, receives driving behaviour data which is indicative of a driving accident event, 2) to store a stationary vehicle location which corresponds to a geographic location which has been determined as being a location at which the vehicle became stationary due to a driving accident event, and to start a timer from the time at which the vehicle is determined as being stationary, 3) to receive additional instantaneous geographical location information from said device after said time that a driving accident has been determined and 4)

to determine whether said additional instantaneous geographical location information received from said device after said time that a driving accident event has been determined exceeds a predetermined distance from said stored stationary vehicle location by more than a predetermined amount within a predetermined time period, the predetermined time period measured by said timer, and wherein the data processor configured to determine that an actual driving accident is less likely to have occurred when the device has changed its geographical position by more than said predetermined distance in said predetermined time, and the data processor is further configured to determine that an actual driving accident is more likely to have occurred when the change in geographical position does not exceed said predetermined distance within said predetermined time.

2. The apparatus of claim 1, wherein the data processor is a driving behaviour monitoring data processor.

3. The apparatus of claim 1, wherein the driving behaviour monitoring device is operative to collect, process and transmit to the data processor driving behaviour data.

4. The apparatus of claim 1, wherein the data processor is configured to communicate with the device by way of a telecommunications network.

5. The apparatus of claim 1, wherein the data processor is part of a server node.

6. The apparatus of claim 1, wherein the data processor is configured to determine when a sequence or combined sequence of detected events, or one of a plurality of specified events, occurs, which sequence or event is predetermined as being indicative of a potential accident.

7. The apparatus of claim 1, further comprising a memory configured to store a plurality of potential accident event sequences.

8. The apparatus of claim 1, wherein the device is configured to receive a plurality of data input sources which are used to perform driving monitoring.

9. The apparatus of claim 1, wherein the device is configured to receive data inputs including at least one of the following:

vehicle operating data;
vehicle speed;
acceleration; and
deceleration.

10. A driving behaviour monitoring device, comprising a data processor and a geographic positioning module, the processor configured to record a geographic al location of a stationary vehicle which corresponds to a geographic location which has been determined as being a location at which the vehicle became stationary due to a driving accident event and to determine whether the device has changed its geographical position by more than a predetermined distance within a predetermined time as determined by a timer, relative to the location of the stationary vehicle, wherein the processor is configured to determine that an actual driving accident is less likely to have occurred if the device has changed its geographical position by more than said predetermined distance in said predetermined time, and the processor is configured to determine that an actual driving accident is more likely to have occurred if the change in geographic al position does not exceed said predetermined distance within said predetermined time.

11. The driving behaviour monitoring device according to claim 10 in which when the monitoring functionality is activated, positional data of the vehicle, or data derived from the positional data, is recorded and/or output by the device.

12. The driving behaviour monitoring device according to claim 10 further comprising an installed software application which is operative to implement driving monitoring functionality.

13. The driving behaviour monitoring device according to claim 10 in which the geographic positioning module is configured to communicate with a satellite positioning system.

14. The driving behaviour monitoring device according to claim 10 further comprising a cellular mobile telecommunications device or telephone.

15. The driving behaviour monitoring device according to claim 10 which is configured to determine a speed and/or an acceleration of the vehicle.

16. The driving behaviour monitoring device of claim 10 in which the data processor is configured to measure changes in acceleration experienced by the device.

17. The driving behaviour monitoring device according to claim 16, wherein the data processor is configured to determine sequences of changes in acceleration experienced by the device, and wherein the data processor is further configured to compare the sequences to stored patterns of acceleration.

18. The driving behaviour monitoring device according to claim 17, wherein the data processor is configured to determine whether there is sufficient similarity between a measured acceleration sequence and a stored acceleration pattern and if it is determined that there is a sufficient similarity which is indicative of a driving accident event.

* * * * *